US006030488A

United States Patent [19]

Izumi et al.

[11] Patent Number: 6,030,488

[45] Date of Patent: Feb. 29, 2000

[54] CHEMICAL AND MECHANICAL POLISHING APPARATUS

[75] Inventors: Shigeto Izumi; Hatsuyuki Arai, both of Ayase, Japan

[73] Assignee: Speedfam Co., Ltd., Ohta-ku Tokyo, Japan

[21] Appl. No.: 09/013,250

[22] Filed: Jan. 26, 1998

[30] Foreign Application Priority Data

Feb. 6, 1997 [JP] Japan ..... 9-038427

[51] Int. Cl.[7] ..... C23F 1/02

[52] U.S. Cl. ..... 156/345; 451/388

[58] Field of Search ..... 156/345; 451/388

[56] References Cited

U.S. PATENT DOCUMENTS 4,954,141 9/1990 Takiyama et al. .

FOREIGN PATENT DOCUMENTS 0 454 362 10/1991 European Pat. Off. .
0 578 351 1/1994 European Pat. Off. .
3-173129 7/1991 Japan .

OTHER PUBLICATIONS

Patent Abstracts of Japan, vol. 096, No. 004, Apr. 30, 1996 & JP 07 320995 (Sony Corp.), Dec. 8, 1995.
Patent Abstracts of Japan, vol. 012, No. 190 (M–704), Jun. 3, 1988 & JP 62 297063 (Hitachi Ltd.), Dec. 24, 1987.

*Primary Examiner*—Robert Dawson
*Assistant Examiner*—Jeffrey Robertson
*Attorney, Agent, or Firm*—Snell & Wilmer, L.L.P.

[57] ABSTRACT

A CMP apparatus has an extended life and improved polishing accuracy and is capable of not only preventing a wafer 100 from dashing out of a carrier 1 and being damaged or wound, but also adjusting the elasticity of a pressure pad to a desired value in a fine manner. The CMP apparatus includes the carrier 1, a suction mechanism 4 having an air passage 40 disposed to open on a lower surface of the carrier 1 for drawing air, and a surface plate 300 having a hard polishing pad 220 and a soft pad 210 adhered thereto. The pressure pad in the form of a porous thin Teflon layer 7 having a thickness of 5 mm is adhered to a lower surface of the carrier 1 which holds the wafer 100. Thus, the rear surface of the wafer 100 is maintained in a horizontal state by the Teflon layer 7, and the warpage and/or irregularities in the thickness of the wafer 100, which appear on the front surface of the wafer 100, can be absorbed by the soft pad 210 and the hard polishing pad 220.

12 Claims, 8 Drawing Sheets

FIG. 4

| | |
|---|---|
| FLATNESS | 1 μm |
| PARALLELISM | 3 μm |
| HOLE DIAMETER × NUMBER | ϕ3 μm × 5100 / cm² |
| PARTICLE DIAMETER | ϕ3 μm ~ 150 μm |
| POROSITY | 42 % |
| MATERIAL | TRIFLUOROCHLOROETHYLENE |
| YOUNG'S MODULUS | 50 kg / mm² |
| SHORE HARDNESS D | 60° |
| COEFFICIENT OF LINEAR EXPANSION | $6.6 \times 10^{-5}$ / °C |
| ELASTIC RECOVERY RATE | 88 % OR MORE |

CHEMICAL AND MECHANICAL POLISHING APPARATUS

BACKGROUND OF THE INVENTION

1. Field of the Invention

The present invention relates to a chemical and mechanical polishing (hereinafter simply referred to as CMP) apparatus for flattening or planarizing a surface of an object such as a wafer.

2. Description of the Related Art

In recent years, as manufacturing of semiconductor devices with high density and high integration advances, ultra-large-scale integrated (hereinafter simply referred to as ULSI) circuit devices having great capacities becomes popular. In the ULSI manufacturing process, a technique of flattening a multi-layer film is required, and the CMP apparatus is used for that purpose.

FIG. 11 is a sectional view showing one example of a surface flattening operation with such a CMP apparatus.

When a surface of an object in the form of a wafer 100 comprising a silicon substrate 101 and an oxide film 102 of $SiO_2$ formed thereon is polished by using a CMP apparatus as shown in FIG. 11(*a*), rugged or irregular portions of the oxide film 102 are removed so as to flatten or planarize the surface thereof as shown in FIG. 11(*b*).

Since the wafer 100 actually involves warpage and/or irregularities or variations in its thickness as shown in FIG. 12, however, it is quite difficult to flatten the wafer 100 by use of the CMP apparatus to any satisfactory extent.

Thus, the flattening of the wafer 100 having warpage, etc., was done by the conventional CMP apparatus using a system shown in FIGS. 13(*a*) and 13(*b*).

FIG. 13(*a*) is a sectional view showing surface flattening due to a so-called rear surface reference method. In FIG. 13(*a*), reference symbol 1 designates a carrier which has a holder 2 for holding an object to be polished in the form of a wafer 100 and a carrier shaft 3 fixedly coupled to a cone-shaped outer surface of the holder 2, the carrier 1 serving to firmly hold the wafer 100 on a surface plate 300 disposed under the carrier 1 during a polishing operation.

More specifically, a hard pad 200 made of foam urethane is attached or adhered to an inner surface of the holder 2 disposed on the opposite side of the carrier shaft 3. The hard pad 200 has a lot of holes 201 in communication with corresponding branches of an air passage 40 formed through the body of the holder 2 and the carrier shaft 3.

Moreover, a soft pad 210 and a hard polishing pad 220 are secured or adhered to an upper surface of the surface plate 300 in a laminated or stacked manner. The soft pad 210 may be in the form of a non-woven fabric pad such as one commercially available under the trade name of "Suba 400", and the hard polishing pad 220 may be in the form of a polishing pad made of foam urethane such as one commercially available under the trade name of "IC 1,000".

With this arrangement, a lower surface of the hard pad 200 attached to the carrier 1 is made in contact with the wafer 100 so that air in a space between the lower surface of the hard pad 200 and the wafer 100 is evacuated through the air passage 40 in the carrier 1 by means of an unillustrated air pump connected to the air passage 40 whereby the wafer 100 is sucked or attracted under vacuum to the lower surface of the hard pad 200. Then, the wafer 100 thus fixedly held by the carrier 1 is transferred to a position over the hard polishing pad 220 of the surface plate 300, where the wafer 100 is made in contact at its lower surface with the hard polishing pad 220 through a downward motion of the carrier 1. Thereafter, the suction force applied to the wafer 100 is released, allowing the wafer 100 on the hard polishing pad 220 to move relative to the carrier 1 and hence the hard pad 200 with the result that the opposite surfaces of the wafer 100, which is being urged against the hard polishing pad 220 by means of a downward force or movement of the carrier 1, are polished by means of the hard polishing pad 220 of the rotating surface plate 300 and the hard pad 200 of the carrier 1 which is rotating in a direction opposite a rotational direction in which the surface plate 300 is rotating.

In this case, the rear or second surface 100*b* of the wafer 100 is pressed so as to be flat by means of the hard pad 200, so that influences of warpage and/or irregularities in the thickness of the wafer 100 appear at the front or first surface 100*a* of the wafer 100.

However, since there exists the soft pad 210 on the side of the front or first surface 100*a* of the wafer 100, the hard polishing pad 220 is deflected together with the soft pad 210 along the curved contour of the front surface 100*a*. As a result, the surface 100*a* of the wafer 100 is polished by a constant thickness and flattened by means of the hard polishing pad 220.

On the other hand, FIG. 13(*b*) is a sectional view showing surface flattening due to a so-called front surface reference method. In this method, to the inner surface of a holder 2 there is attached or adhered a soft pad 230 in the form of a suede-type pad such as, for example, one commercially available under the trade name of "R200" which has a lot of through-holes 231 with which an air passage 40 is in communication through a plurality of corresponding branches in the holder 2. A hard polishing pad 220 is secured or adhered to the surface plate 300.

With this arrangement, the front surface 100*a* of the wafer 100 is urged or pushed so as to be flat by the hard polishing pad 220, and influences of warpage and/or irregularities in the thickness of the wafer 100 appear on its rear surface 100*b*. However, since there exists the soft pad 23 on the rear surface 100*b* of the wafer 100, the soft pad 230 is deformed along the curved contour of the rear surface 100*b* of the wafer 100. Consequently, the flat surface 100*a* of the wafer 100 is polished by a constant amount of thickness and thus flattened by means of the hard polishing pad 220.

However, the above-mentioned CMP apparatuses involve the following problems.

The first problem is that the elastic recovery rates of the hard pad 200 and the soft pad 230 attached to the holder 2 are low or poor. That is, the elastic recovery rate of the pad made of foam urethane used in general as the hard pad 200 is about 80%, so the foam urethane pad could not return to the original shape after a short period of use, and hence the duration or life thereof is short. Especially, the elastic recovery rate of "R200" used in general as the soft pad 230 varies within the range from 70% to 98% depending upon goods manufactured. Therefore, the soft pad 230 in the form of a product with a bad or low elastic recovery rate is not only of a short life, but also the polishing accuracy thereof will be deteriorated in a short period of use in other words, the soft pad 230 elastically deforms along the curved contour of the rear surface 100*b* of the wafer 100 so as to allow the surface 100*a* of the wafer 100 to be subjected to a uniform pressure, whereby the wafer surface 100*a* can be polished in a uniform manner while being held in a substantially flat state.

However, the soft pad 230, when the elasticity thereof has been deteriorated, can not deform along the curved contour of the rear surface 100*b* of the wafer 100, as a consequence of which the pressure or urging force applied from the soft pad 230 to the wafer 100 will become irregular or nonuniform, making the polishing speed of the wafer 100 different at portions thereof.

The second problem is that a lot of dents or recesses in the shape of dimples are created on the surface 100*a* of the wafer 100. That is, through-holes 201, 231 of diameters in a range from 1 mm to 2 mm which communicate with the corresponding branches of the air passage 40 are formed through the hard pad 200 and the soft pad 230, as shown in FIG. 13(*a*) and FIG. 13(*b*). When the carrier 1 transports a wafer 100 onto the surface plate 300, air in a space between the carrier 1 and the wafer 100 is discharged or evacuated via the through-holes 201 or 231 in the pad 200 or 230 and the air passage 40 by means of the unillustrated air pump connected with the air passage 40, so that the wafer 100 is sucked or attracted to the hard pad 200 or the soft pad 230 of the carrier 1 under the action of a vacuum. When the wafer 100 is polished, the suction or attractive force acting on the wafer 100 is liberated so that the wafer 100 is not partially sucked into the through-holes 201 or 231. However, a great pressure of 500 g/cm$^2$ is applied downward to the wafer 100 during polishing operation. As a result, those portions of the wafer 100 which are located at through-holes 201 or 231, as shown in FIG. 14, are pushed into the through-holes 201 or 231, thus creating recesses or dents 100*c* in the shape of dimples on the surface 100*a* of the wafer 100.

The third problem is that the wafer 100 might be dashed or flied out from the carrier 1 and damaged while the wafer 100 is polishing. That is, since the carrier 1 rotates at high speed while holding the wafer 100 with the surface plate 300 being also rotating, there might be the case that the wafer 100 occasionally happens to dash or fly out from the carrier 1 for some reason. In order to cope with this, it is preferred that air in the space between the wafer 100 and the pad 200 or 230 of the carrier 1 be evacuated or discharged through the through-holes 201 or 231 and the air passage 40 in the carrier 1 to thereby draw the wafer 100 against the carrier 1 even during polishing of the wafer 100. If, however, the drawing or suction force acts on the wafer 100 via through-holes 201 or 231, the dimple-shaped dents 100*c* in the wafer 100 grow deeper or greater, further worsening the surface state of the wafer 100.

The fourth problem is that it is difficult to afford a desired magnitude of elasticity to the wafer 100. For instance, as shown in FIG. 13(*a*), the apparatus is constructed such that it includes one hard pad 200 made of foam urethane, one soft pad 210 in the form of "Suba400", and one hard polishing pad 220 in the form of "IC1,000". However, there sometimes arises a case that the thickness of each pad is desired to be varied so as to change the amount of deformation thereof depending upon the kind or type of the wafer 100 to be polished. Since the thickness of each of these pads is standardized and can not be varied, however, two or more hard pads 200 are used which are secured to the inner surface of the holder 2 in a laminated or stacked manner, and two or more soft pads 210 are secured to the surface of the surface plate 300 beneath the single hard polishing pad 220 similarly in a laminated or stacked manner. In this manner, lamination of a plurality of pads each having a fixed or same thickness results in a discrete value of the total thickness of the pads, so it is difficult to set the total thickness of the laminated pads to a desired value, thus making it difficult to adjust a slight amount of deformation of the pads.

The fifth problem is that the composition of the pad on the rear surface of the wafer 100 is changed by a polishing agent such as slurry. That is, chemical substances such as alkaline materials and acidic materials might be included in the slurry which is used as a polishing material, and the composition of the hard pad 200 or the soft pad 230 can be changed by such chemical substances, resulting in deformations and/or changes in the hardness and elasticity of the pad.

SUMMARY OF THE INVENTION

In view of the above, the present invention is intended to obviate the various problems as mentioned above, and has for its object to provide a novel and improved chemical and mechanical polishing apparatus which has a prolonged period of life and an improved accuracy in polishing, and which can prevent an object to be polished from inadvertently dashing out from a carrier and hence the resultant damage thereof, and in which the elasticity of a pressure pad can be adjusted to a desired magnitude of elasticity without any difficulty.

Bearing the above object in mind, according to a first aspect of the present invention, there is provided a chemical and mechanical polishing apparatus comprising: a surface plate adapted to be rotatable and having a polishing pad attached thereto through a soft elastic pad; a carrier having a support surface for supporting an object to be polished which has a first surface and a second surface on the opposite sides thereof; a pressure pad attached to the support surface of the carrier for urging the object to be polished against the polishing pad, the pressure pad being formed of a thin porous elastic member so as to maintain the second surface of the object to be polished at a substantially flat state when urging the object against the polishing pad; and a holding means provided on the carrier for holding the object to be polished on the pressure pad; whereby the first surface of the object, which is urged from the second surface thereof into contact with the polishing pad of the surface plate by means of the carrier through the pressure pad, is polished by the rotating polishing pad.

With this construction, the object to be polished such as a wafer is held by the carrier through the pressure pad and urged toward the polishing pad by means of the carrier. When the surface plate is driven to rotate while the object is being urged onto the polishing pad by means of the carrier, the rear surface of the object is maintained flat or planar by means of the thin pressure pad, and the soft elastic pad is deformed so that the surface of the wafer is uniformly pressed by the polishing pad.

In a preferred form of the invention according to the first aspect, the holding means comprises an air passage which opens on the support surface of the carrier for drawing air.

Thus, when air is drawn from the air passage by the holding means, air in the porous pressure pad is evacuated, causing the wafer to be sucked to the pressure pad.

In another preferred form of the invention according to the first aspect, the thin porous elastic member has a multitude of minute pores.

In a further preferred form of the invention according to the first aspect, the thin porous elastic member comprises a trifluorochloroethylene resin.

Thus, the surface of the wafer is maintained flat or planar by means of the thin trifluorochloroethylene resin so that when the holding means is operated, the wafer is sucked to the trifluorochloroethylene resin.

In a further preferred form of the invention according to the first aspect, the thin porous elastic member comprising a trifluorochloroethylene resin has a thickness of about 5 mm.

In a yet further preferred form of the invention according to the first aspect, that surface of the pressure pad which is in contact with the second surface of the object to be polished is a flat and smooth surface having substantially no irregularities.

With this arrangement, the rear surface of the wafer comes in contact with the flat and smooth surface of the pressure pad having substantially no convex, so there will be created no dimple or dent on the rear surface of the wafer due to these surface-to-surface contact.

According to a second aspect of the present invention, there is provided a chemical and mechanical polishing apparatus comprising: a surface plate adapted to be rotatable and having a polishing pad attached thereto through a soft elastic pad; a carrier having a support surface for supporting an object to be polished which has a first surface and a second surface on the opposite sides thereof; a pressure pad attached to the support surface of the carrier for urging the object to be polished against the polishing pad, the pressure pad being formed of a thick porous elastic member such that it is deformable along a contour of the second surface of the object to thereby maintain the second surface of the object to be polished at a substantially flat state when urging the object against the polishing pad; and a holding means provided on the carrier for holding the object to be polished on the pressure pad; whereby the first surface of the object, which is urged from the second surface thereof into contact with the polishing pad of the surface plate by means of the carrier through the pressure pad, is polished by the rotating polishing pad.

With this construction, the object to be polished such as a wafer is held by the carrier through the thick pressure pad and urged toward the polishing pad by means of the carrier. When the surface plate is driven to rotate while the object is being urged onto the polishing pad by means of the carrier, the rear surface of the object is maintained flat or planar by means of the thick pressure pad, and the soft elastic pad is deformed so that the surface of the wafer is uniformly pressed by the polishing pad.

In a preferred form of the invention according to the second aspect, the holding means comprises an air passage which opens on the support surface of the carrier for drawing air.

In a further preferred form of the invention according to the second aspect, the thick porous elastic member has a multitude of minute pores.

In a still further preferred form of the invention according to the second aspect, the thick porous elastic member comprises a trifluorochloroethylene resin.

In a yet further preferred form of the invention according to the second aspect, the thick porous elastic member comprising a trifluorochloroethylene resin has a thickness of 8 mm or more.

In a further preferred form of the invention according to the second aspect, that surface of the pressure pad which is in contact with the second surface of the object to be polished is a flat and smooth surface having substantially no irregularities.

The above and other objects, features and advantages of the present invention will become more readily apparent to those skilled in the art from the following detailed description of preferred embodiments of the invention taken in conjunction with the accompanying drawings.

BRIEF DESCRIPTION OF THE DRAWINGS

FIG. 4 is a table chart showing the physical properties of a Teflon layer;

DESCRIPTION OF THE PREFERRED EMBODIMENTS

In the following, preferred embodiments of the present invention will be described while referring to the accompanying drawings.

(First Embodiment)

Figure 1:
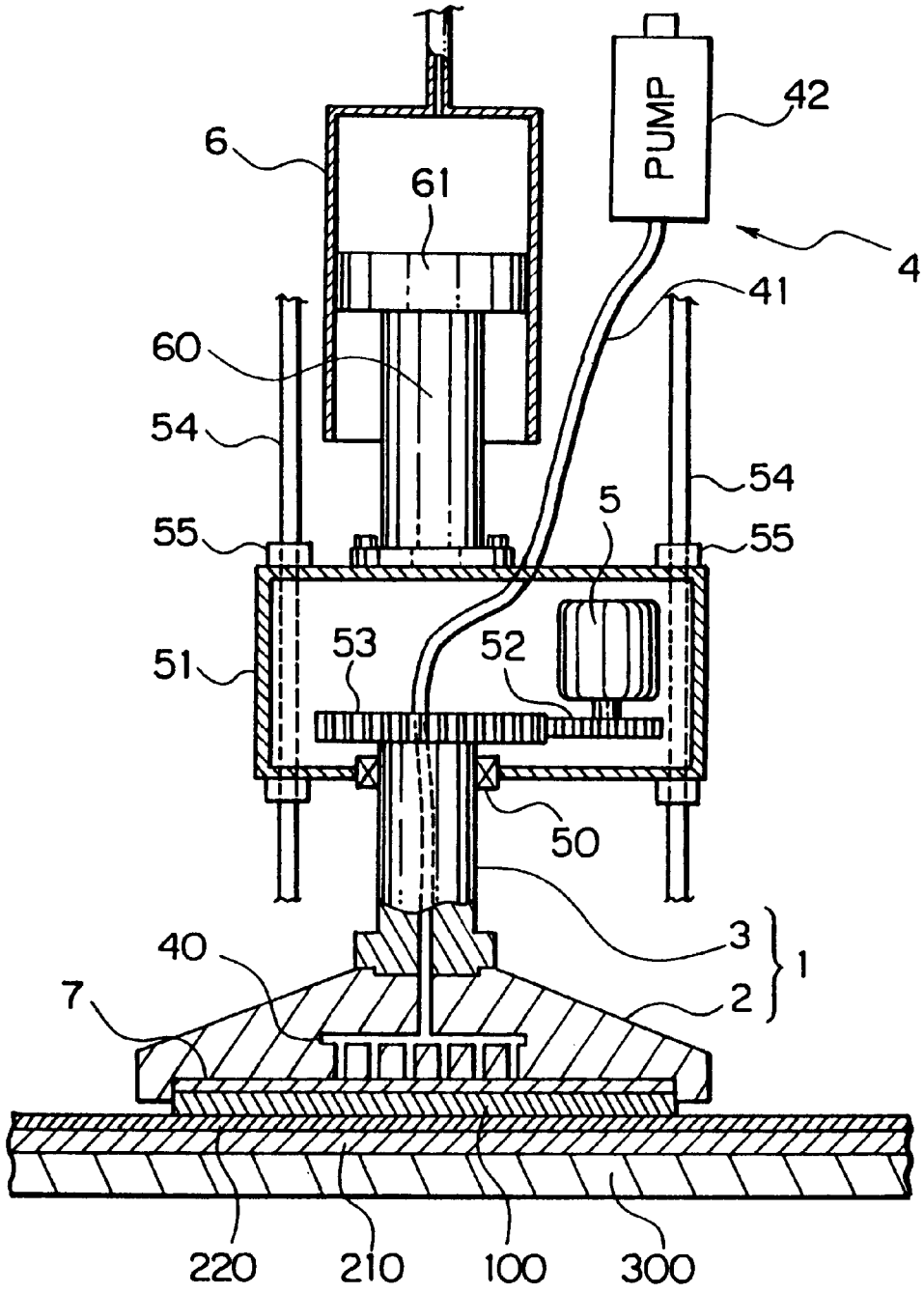
FIG. 1 is a schematic view showing the construction of a CMP apparatus according to a first embodiment of the present invention.

FIG. 1 schematically illustrates the construction of a CMP apparatus in accordance with a first embodiment of the present invention. As shown in FIG. 1, the CMP apparatus has a carrier 1, a holding means in the form of a suction mechanism 4, and a surface plate 300.

Figure 2:
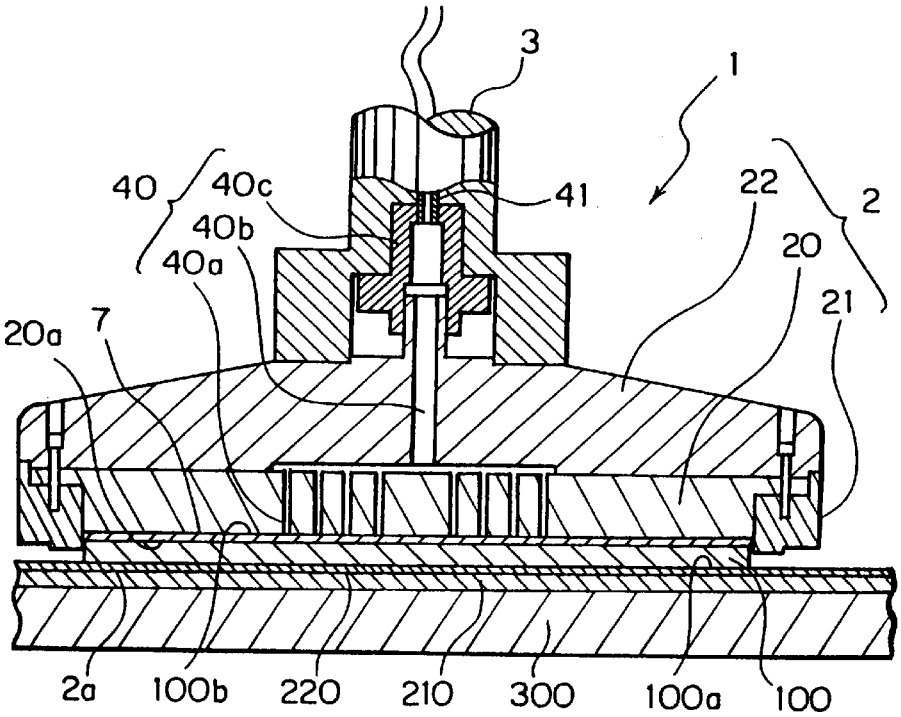
FIG. 2 is a sectional view showing the detailed structure of a carrier of FIG. 1.

The carrier 1 is rotatable about its own axis of rotation while holding an object to be polished such as a wafer 100. Specifically, the carrier 1 is composed of a holder 2 for holding the wafer 100, and a carrier shaft 3 for supporting the holder 2 at its upper portion, as shown in FIG. 2. The holder 2 is provided at its lower portion with a pressure plate 20. An extension ring 21 is fitted over the outer peripheral surface of the pressure plate 20 in such a manner that it projects downward from a lower surface of the pressure plate 20 to thereby define a circular space 2*a* for receiving the wafer 100 at a location beneath the pressure plate 20. In addition, disposed on the pressure plate 20 is a housing 22 which is bolted to the pressure plate 20 and the extension ring 21 so as to integrally fasten these members.

The carrier shaft 3 has a lower end fitted to and fixedly coupled to a central portion of an upper surface of the holder 2 and an upper end operatively connected with a drive means in the form of a motor 5, as shown in FIG. 1.

Specifically, mounted on an upper part of the carrier shaft 3 through an annular bearing 50 is a frame 51 to which the motor 5 is mounted. The motor 5 is provided with a gear 52 which is fixedly secured to a rotation shaft thereof. The gear 52 is in meshing engagement with a gear 53 which is fixedly mounted on the upper end of the carrier shaft 3.

With this arrangement, the rotational force or torque of the motor 5 is transmitted to the carrier 1 through the gears 52 and 53, so that the carrier 1 is caused to rotate on its own axis of rotation, i.e., about the central axis of the carrier shaft 3.

The frame 51 is installed on vertically extending rails 54 through guide members 55 for free vertical motion relative thereto, with a cylinder 6 being connected with the frame 51. The cylinder 6 is vertically disposed and firmly supported by an unillustrated support member. The cylinder 6 has a piston 61 vertically slidably received therein with a piston rod 60 being connected at its upper end with the piston 61 and at its lower end with an upper surface of the frame 51.

With such an arrangement, by changing the air pressure in the cylinder 6, the piston 61 and hence the piston rod 60 are caused to move up and down relative to the fixedly supported cylinder 6, thus integrally driving the frame 51 along the vertically extending rails 54 in a vertical direction together with the carrier 1 supported by the frame 51. In this manner, the carrier 1 is caused to move in a vertical direction under the action of the cylinder 6 so as to be pushed against the surface plate 300 or lifted therefrom.

A pressure pad in the form of a Teflon layer 7 is attached or adhered to a lower surface of the carrier 1, which is driven to rotate by means of the motor 5 and pushed or urged against the surface plate 300 by the cylinder 6, for polishing the wafer 100 through a rear surface reference method.

FIG. 4 is a table chart in which the physical properties of the Teflon layer 7 are shown. As shown in FIG. 4, the Teflon layer 7 is a porous elastic member formed of a trifluorochloroethylene resin. That is, the Teflon layer 7 contains 5,100 minute pores having a diameter of 3 $\mu$m per square centimeters, and its Young's modulus indicative of its elasticity is 50 kg/square millimeters, and its elastic recovery rate is 88% or more. Moreover, Shore hardness D is 60 degrees, and very low as compared with the hardness of ceramic, silicon and the like. The thickness of the Teflon layer 7 having such physical properties is set to 5 mm. The Teflon layer 7 is adhered to the entire surface of a wafer support surface 20*a* which is the lower surface of the pressure plate 20, as shown in FIG. 2.

Specifically, the rear surface of the Teflon Layer 7 is bonded to the wafer support surface or rear surface 20*a* of the pressure plate 20 through an epoxy-based adhesive. The adhesive is impregnated between the outer peripheral surface of the pressure plate 20 and the inner peripheral surface of the extension ring 21. A space defined between the pressure plate 20 and the extension ring 21 is kept airtight. However, since the Teflon layer 7 is porous, air can be drawn from the front surface (lower-side surface in FIG. 2) of the Teflon layer 7.

Figure 5A:
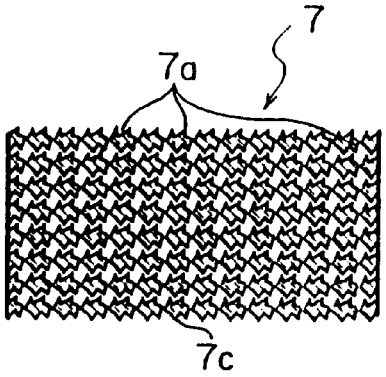
FIGS. 5(*a*) and 5(*b*) are schematic cross sections of Teflon layers which are formed by solidifying Teflon particles.
Figure 5B:
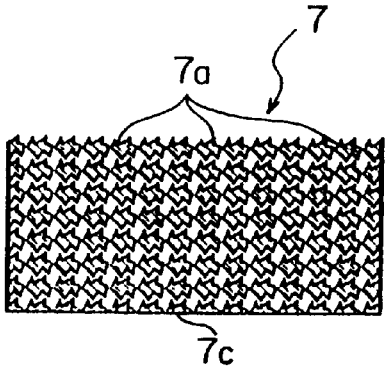

Moreover, the surface of the Teflon layer 7 (i.e., the surface which is in contact with the wafer 100) is formed into a flat or planar surface without inclusion of convexes. Specifically, the Teflon layer 7 is formed by solidifying Teflon particles 7*a* as shown in FIG. 5(*a*).

In the case where interstices formed between the particles are used as pores, the surface 7*c* of the Teflon layer 7 at the time of its manufacture is in an irregular or rugged state including a multitude of convexes and concaves owing to the Teflon particles 7*a*. Thus, in this embodiment, the surface 7*c* of the Teflon layer 7 is polished or milled into a flat or smooth surface, as shown in FIG. 5(*b*).

Figure 6A:
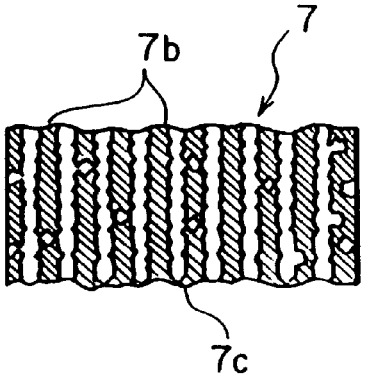
FIGS. 6(*a*) and 6(*b*) are schematic cross sections of Teflon layers with inclusion of air bubbles.
Figure 6B:
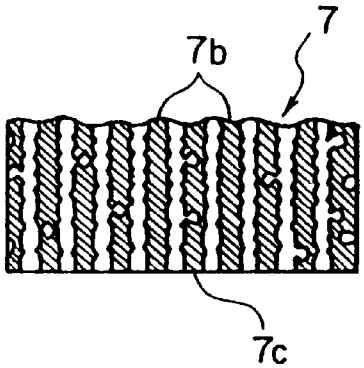

Moreover, as shown in FIG. 6(*a*), in the case where a Teflon material with inclusion of air bubbles is solidified to provide fine or minute holes 7*b* which result from the air bubbles and communicate with each other so as to be utilized as air vents or pores, the surface of the Teflon layer 7 might be irregular or rugged including concaves and convexes. Therefore, in this case, too, the surface 7*c* of the Teflon layer 7 is made smooth or flat, as shown in FIG. 6(*b*).

Turning now to FIG. 1, the suction mechanism 4 serves to attach the wafer 100 to the surface of the Teflon layer 7 by making effective use of the pores in the Teflon layer 7, and it comprises an air passage 40 formed in the holder 2, a tube 41 connected with the air passage 40, and a pump 42 which draws or suck air in the air passage 40 and the tube 41.

Specifically, as shown in FIG. 2, the air passage 40 comprises a plurality of small-diameter passages or branches 40*a* formed in the pressure plate 20 so as to open on the wafer support surface 20*a* thereof, and a large-diameter passage 40*b* formed through the central portion of the housing 22 and connected with the small-diameter passages 40*a*.

A hollow coupling member 40*c* is fitted to the top end of the large-diameter passage 40*b*. The tube 41 extending from the pump 42 is connected with the coupling member 40*c*.

On the other hand, in FIG. 1 and FIG. 2, the surface plate 300 is operatively connected with an unillustrated drive means such as a motor so that it is thereby driven to rotate and polish the wafer 100.

An elastic pad in the form of a soft pad 210 comprising a foamed pad commercially available under the trade name of "Suba400" is attached or adhered to an upper surface of the surface plate 300. A hard polishing pad 220 such as a plastic polishing pad commercially available under the trade name of "IC1,000" is adhered to an upper surface of the soft pad 210.

Now, the operation of the CMP apparatus in accordance with this embodiment will be explained below.

Before a wafer 100 is polished, the carrier 1 is lifted up by means of the cylinder 6 as shown in FIG. 1. The wafer 100 being polished, which has previously been transported to an unillustrated location, is fitted into the circular space 2*a* inside the carrier 1, and then the pump 42 is energized to operate, so that air is evacuated from the pores in the Teflon layer 7 with which the wafer 100 is in abutment, so as to be drawn to the pump 42 by way of the air passage 40 in the carrier 1 and the tube 41. As a result, the insides of the pores in the Teflon layer 7 become vacuum, causing the wafer 100 to be sucked to the Teflon layer 7.

Under such a condition, the carrier 1 is moved downward by means of the cylinder 6 and driven to rotate by mean of the motor 5 to thereby push the wafer 100 onto the surface plate 300 while injecting an unillustrated polishing agent such as slurry into a space between the wafer 100 and the surface plate 300. As a result, the wafer 100 is forced to rotate with its surface 100*a* being pressed to the hard polishing pad 220 of the surface plate 300, whereby the wafer surface 100*a* is polished by the hard polishing pad 220.

Figure 14:
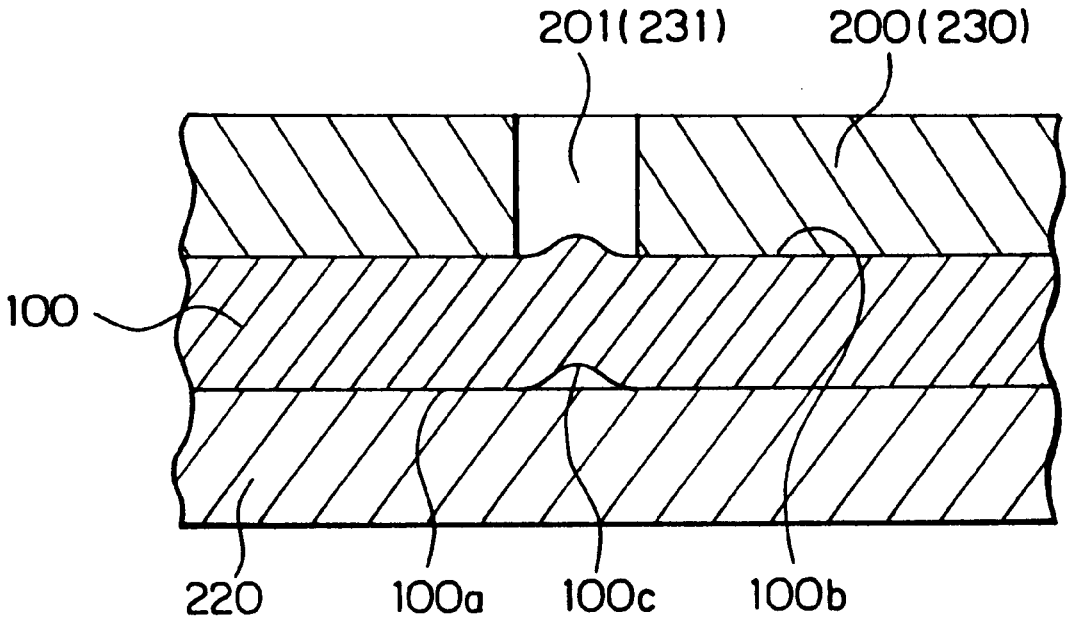
FIG. 14 is a cross section showing the state of generation of dimple-like recesses or dents.

At this time, a large pressure of 500 g/cm2 is applied to the wafer 100 through the Teflon layer 7, and at the same time the wafer 100 is being sucked to the Teflon layer 7 by means of the suction mechanism 4. As a consequence, there might be created dimple-shaped recesses or dents, as shown in FIG. 14, on the surface 100*a* of the wafer 100. However, there will not be developed any dimple-like dents or recesses under the action of the above-mentioned pressure and the suction force because the pores in the Teflon layer 7 are minute holes of a diameter of about 3 $\mu$m.

Moreover, even if the carrier 1 happens to be inclined for some reason, the wafer 100 rotating at a high speed does not dash or fly out from the carrier 1 because the wafer 100 is sucked or firmly attached to the carrier 1 under the action of a vacuum.

In the case where the Teflon layer 7 is formed by solidifying Teflon particles 7*a,* as shown in FIG. 5(*a*), that surface of the wafer 100 which is in contact with the Teflon layer 7 is pressed or pushed by the Teflon particles 7*a* projecting from the surface 7*c* of the Teflon layer, so that there might be created a number of minute dimple-like recesses or dents 7 on the surface of the wafer 100 in contact with the Teflon layer 7. Since the surface 7*c* of the Teflon layer 7 is polished to form a flat and smooth surface, as shown in FIG. 5(*b*), however, there will not be above-mentioned minute dimple-like recesses or dents developed on the surface of the wafer 100.

Furthermore, even when the Teflon layer 7 is formed with inclusion of air bubbles, as shown in FIG. 6(*a*), there will be created no minute dimple-like recesses or dents on the surface 7*c* of the Teflon layer 7 which is made smooth and flat, as shown in FIG. 6(*b*).

Figure 3:
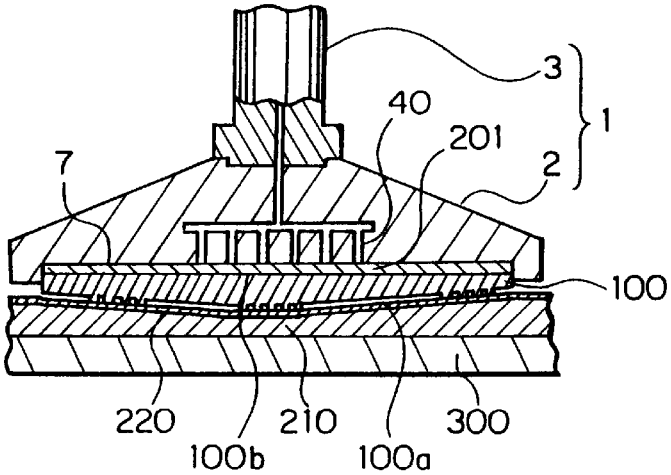
FIG. 3 is a schematic cross section showing the operation of the CMP apparatus of the first embodiment.
Figure 7:
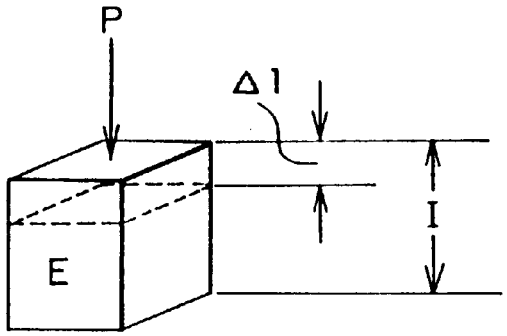
FIG. 7 is an explanatory view showing an amount of change or deformation in the elastic member.

When the wafer 100, which has warpage and variations or irregularities in the thickness thereof, is urged against the surface plate 300 by means of the carrier 1, the Teflon layer 7 elastically deforms. In this regard, however, an elastic member having a thicknessI and a Young's modulus E is deformed by an amount of deformation ΔI under the application of a pressure P, as shown in FIG. 7, so the following relation will be established: P/E:ΔI/I Therefore, when the pressure P of 500 g/cm$^2$ is applied to the Teflon layer 7 which has a Young's modulus E of 50 kg/mm$^2$ and a thicknessI of 5 mm, the resultant amount of deformation ΔI of the Teflon layer 7 is very small. Thus, the wafer 100 does not sink or dent toward the Teflon layer 7 side, and the rear surface 100*b* of the wafer 100 is pressed directly by the pressure plate 20 so as to be flattened or planarized, as shown in FIG. 3. As a result, the warpage and/or irregularities in the thickness of the wafer 100 appear on its front surface 100*a,* which presses or pushes the hard polishing pad 220.

At this time, the soft pad 210, which is provided beneath the hard polishing pad 220, is deformed so that the hard polishing pad 220 is deflected along the curved contour of the wafer surface 100*a,* as a consequence of which the warpage and/or irregularities or variations in the thickness of the wafer 100 are absorbed by the soft pad 210 and the hard polishing pad 220. Thus, the wafer 100 is polished with high accuracy according to the rear surface reference method.

Figure 8:
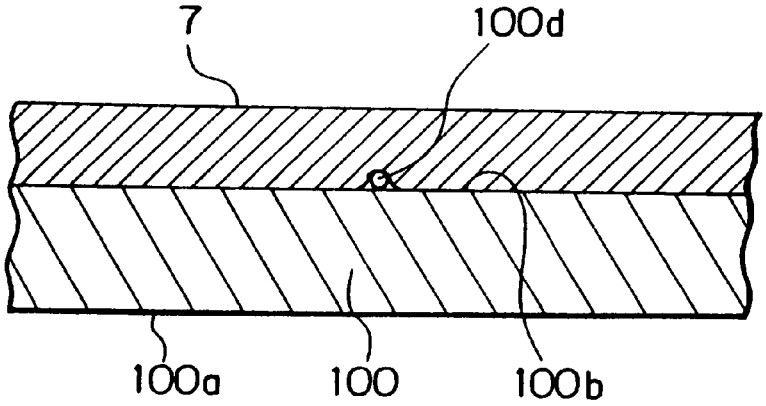
FIG. 8 is a cross section showing the invasion of agglomerated particles.

Moreover, agglomerated particles 100*d* of the polishing agent may occasionally invade in between the surface of the Teflon layer 7 and the rear surface 100*b* of the wafer 100 during the polishing operation, as shown in FIG. 8.

At this time, Shore hardness D of the Teflon layer 7 is 60 degrees, which is smaller or lower than the hardness of ceramic, silicon or the like, so the Teflon layer 7 is dented, allowing the agglomerated particles 100*d* to sink in the Teflon layer 7. Accordingly, the pressure applied to the wafer 100 from the Teflon layer 7 is uniformly distributed over the entire rear surface 100*b* of the wafer 100 without concentrating on the agglomerated particles 100*d,* as a result of which there will be generated no wound or damage of the wafer 100 due to the agglomerated particles 100*d*.

Moreover, the polishing agent in the form of slurry which contains chemical substances such as alkaline materials or acidic materials during the wafer polishing operation adheres to the Teflon layer 7, but the Teflon layer 7 is strong or resistant to these chemical substances, so the composition thereof is not affected by these chemical substances and there will be no deformation of the Teflon layer 7, thus resulting in no change in the hardness and elasticity thereof.

When the wafer 100 has been polished, the rotations of the motor 5 and the surface plate 300 shown in FIG. 1 are stopped, and the carrier 1 having the thus polished wafer 100 sucked thereto is then raised by the cylinder 6 and transported to a predetermined storage place. Thereafter, the operation of the suction mechanism 4 is stopped, and the wafer 100 is released from the carrier 1 and stored in the storage place.

Repeating such a polishing operation for a lot of wafers 100 raises the problem of deterioration in the elasticity of the Teflon layer 7, but the elastic recovery rate of the Teflon layer 7 is 88% or more, which is substantially higher than the conventional hard pad 200 and the soft pad 230 in the form of a foamed urethane pad or a suede-type pad such as one commercially available under the trade name of "R200".

For this reason, the pressure pad formed of the Teflon layer 7 is much more durable for a long period of use as compared with a conventional pad, and hence the CMP apparatus according to this embodiment has a longer life.

In addition, since the Teflon layer 7 is not made of metal but of resin, there will neither be generation of metal contaminations or rust nor any wound or damage of the Teflon layer 7. For these reasons, the apparatus of the present invention is made long-lived.

(Second Embodiment)

Figure 9:
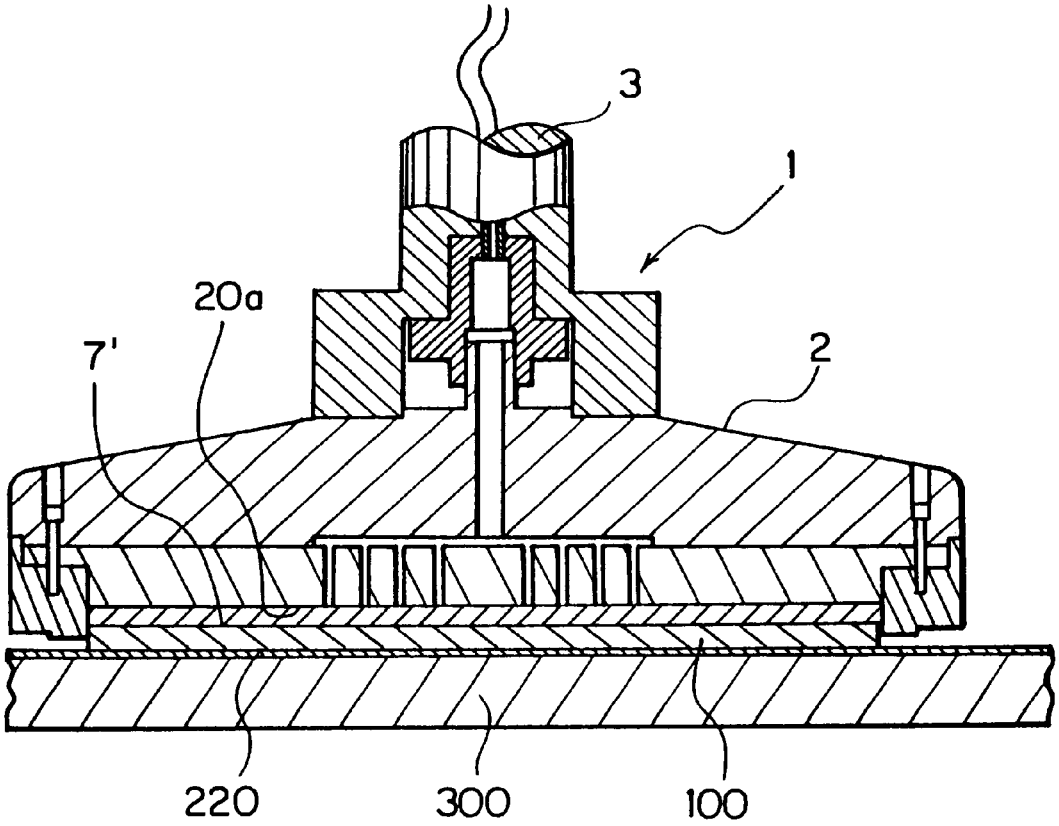
FIG. 9 is a cross section of a carrier showing essential parts of a CMP apparatus according to a second embodiment of the present invention.

FIG. 9 shows in cross section a carrier as an essential portion of a CMP apparatus according to a second embodiment of the present invention.

The CMP apparatus of this embodiment is different from the first-mentioned CMP apparatus according to the first embodiment in that a wafer 100 is polished according to a front surface reference method.

Specifically, as shown in FIG. 9, a Teflon layer 7' of the same physical properties as those of the above-mentioned Teflon layer 7 of the first embodiment is attached or adhered to the wafer support surface 20*a* of the pressure plate 20. The thickness of this Teflon layer 7' is set to 8 mm so as to provide a greater amount of deformation than that of the above-mentioned Teflon layer 7 for the same pressure. Moreover, the hard polishing pad 220 is attached or adhered directly on the surface plate 300.

Figure 10:
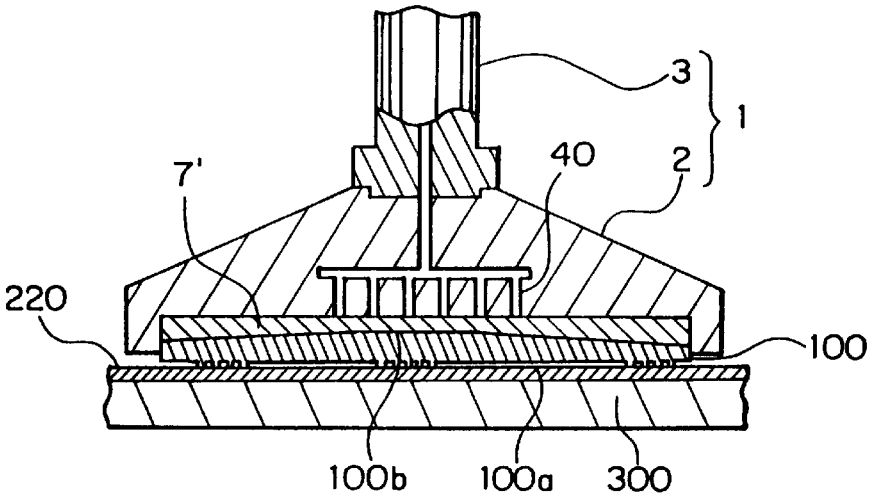
FIG. 10 is a schematic cross section showing the operation of the CMP apparatus according to the second embodiment.
Figure 11A:
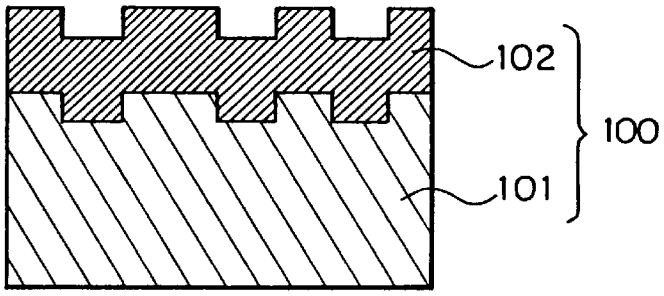
FIGS. 11(*a*) and 11(*b*) are sectional views showing one example of a surface flattening operation with the CMP apparatus of the present invention.
Figure 11B:
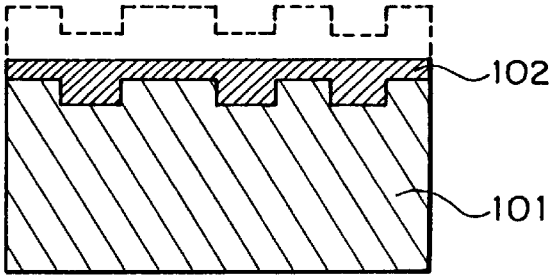
Figure 12:
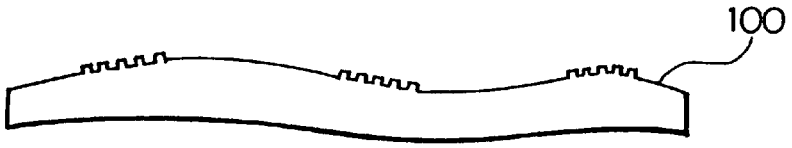
FIG. 12 is a schematic side view showing the state of warpage and irregularities or variations in the thickness of a wafer.
Figure 13A:
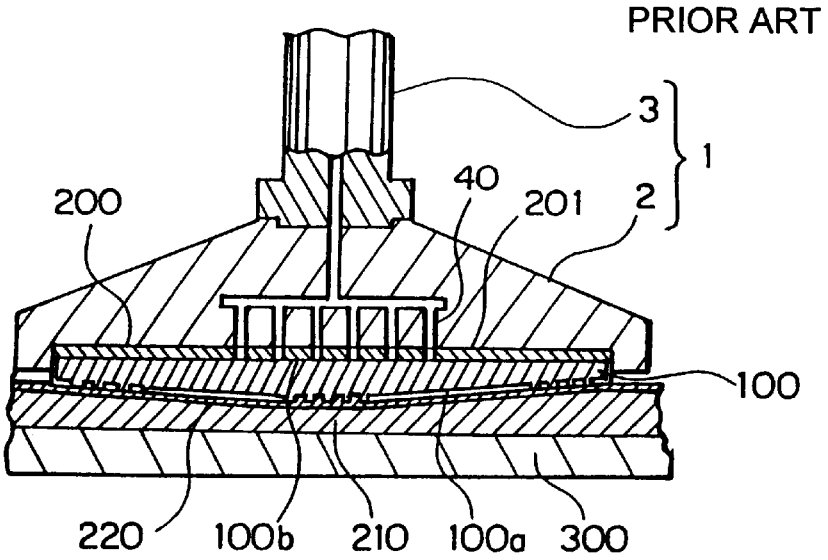
FIGS. 13(*a*) and 13(*b*) are cross sections showing one example of surface flattening with a conventional CMP apparatus.
Figure 13B:
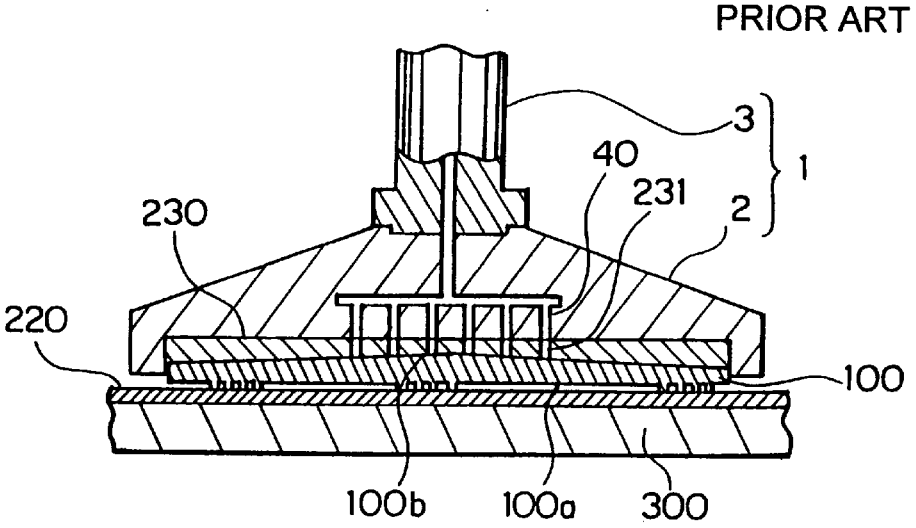

With this arrangement, when the wafer 100 is pressed onto the surface plate 300 at the same pressure as in the first-mentioned embodiment by means of the carrier 1 under the action of the cylinder 6, the surface 100*a* of the wafer 100 is made smooth or flat as shown in FIG. 10, and the warpage and/or irregularities or variations in the thickness of the wafer 100 appear on its rear surface 100*b* because the hard polishing pad 220 is adhered directly on the surface plate 300

The thickness of the Teflon layer 7' on the rear surface 100*b* of the wafer 100 is set to 1.6 times the thickness of the Teflon layer 7 in the aforementioned first embodiment, so the amount of change or deformation ΔI of the Teflon layer 7' accordingly becomes 1.6 times that of the Teflon layer 7. As a result, the rear surface 100*b* of the wafer 100 sinks in the Teflon layer 7', so that the warpage and/or irregularities or variations in the thickness of the wafer 100 which appear on its rear surface 100*b* are absorbed by the Teflon layer 7'.

As a result, the pressure or urging force of the carrier 1 can be uniformly applied to the rear surface 100*b* of the wafer 100, thus achieving highly accurate polishing of the wafer 100 according to the front surface reference method.

Here, it is to be noted that with the elastic member having a large amount of change or deformation as referred to above, when the elasticity thereof has been deteriorated, the rear surface 100*b* of the wafer 100 is not subjected to a uniform pressure. As a consequence, the front surface 100*a* of the wafer 100 is not held flat with a uniform pressure, thus inviting deterioration in the polishing accuracy.

However, the Teflon layer 7' is high in the elastic recovery rate as referred to above, and hence the elasticity thereof can be maintained for a longer period of time as compared with a conventional pressure pad. Thus, according to this embodiment, the CMP apparatus is provided which can maintain the polishing accuracy for a long period of time.

The construction and operation of this embodiment other than the above are similar to those of the first above-mentioned embodiment, and thus a further description thereof is omitted.

Moreover, it will be appreciated that the present invention is not limited to the above-mentioned embodiments but various changes or modifications can be made without departing from the spirit and scope of the invention as defined in the appended claims.

For instance, in the above-mentioned first and second embodiments, the thicknesses of the Teflon layers 7 and 7' are set to 5 mm and 8 mm, respectively, so as to provide predetermined amounts of elastic deformation, but in the case where it is desired to change the amounts of elastic deformation of the Teflon layers 7 and 7' depending upon the kind or type of the wafer 100, this can be achieved by changing the thicknesses of the Teflon layers 7 and 7' in an appropriate manner. That is, a slight adjustment of the deformation amount can be easily done by changing the thicknesses of the Teflon layers.

As described in detail in the foregoing, according to the present invention, since the pressure pad is formed of a porous material having a multitude of minute pores, it is possible to prevent generation of dimple-like recesses or dents during a wafer is urged against the surface plate, thus improving the accuracy in polishing the wafer.

In addition, the wafer can be attached or sucked to the pressure pad without generating recesses or dents on a surface of the wafer, so that it is possible to prevent the wafer from dashing out from the carrier during the wafer polishing operation.

Moreover, since the pressure pad comprises an elastic member, when agglomerated particles of a polishing agent invade into a space between the wafer and the pressure pad, they are buried in the body of the pressure pad. As a result, a pressure or urging force can be applied uniformly to the wafer without concentrating on the agglomerated particles, whereby it is possible to prevent the wafer from being wound or damaged due to the invaded agglomerated particles.

Furthermore, the amount of deformation of the pressure pad can be adjusted merely by changing the thickness of the pressure pad, so that a fine or slight adjustment of the deformation amount of the pressure pad can be done in a simple and easy manner.

Besides, if the elastic member having a multitude of minute pores, which constitutes the pressure pad, is formed of trifluorochloroethylene, the elastic recovery rate of the pressure pad can be improved so it is possible to use the pressure pad for an extended period of time, thus prolonging the effective life of the apparatus.

Moreover, it is possible to provide the apparatus which is capable of maintaining a high degree of polishing accuracy for a long period of time.

Since the trifluorochloroethylene resin is resistant to chemical substances such as alkaline or acidic materials, the composition of the resin is never affected or transformed by these chemical substances contained in the polishing agent or the like, and hence the life of the apparatus can be improved from this aspect.

What is claimed is:

1. A chemical and mechanical polishing apparatus comprising:

a surface plate adapted to be rotatable and having a polishing pad attached thereto through a soft elastic pad;

a carrier having a support surface for supporting an object to be polished which has a first surface and a second surface on the opposite sides thereof;

a pressure pad attached to said support surface of said carrier for urging said object to be polished against said polishing pad, said pressure pad being formed of a porous elastic member of a thickness corresponding to a predetermined amount of elastic deformation so as to maintain the second surface of said object to be polished at a substantially flat state when urging said object against said polishing pad; and a holding means provided on said carrier for holding said object to be polished on said pressure pad;

whereby the first surface of said object, which is urged from the second surface thereof into contact with said polishing pad of said surface plate by means of said carrier through said pressure pad, is polished by said rotating polishing pad.

2. The chemical and mechanical polishing apparatus according to claim 1, wherein said holding means comprises an air passage which opens on the support surface of said carrier for drawing air.

3. The chemical and mechanical polishing apparatus according to claim 1, wherein said porous elastic member has a multitude of minute pores.

4. The chemical and mechanical polishing apparatus according to claim 1, wherein said said porous elastic member comprises a trifluorochloroethylene resin.

5. The chemical and mechanical polishing apparatus according to claim 1, wherein said porous elastic member comprising a trifluorochloroethylene resin has a thickness of about 5 mm.

6. The chemical and mechanical polishing apparatus according to claim 1, wherein that surface of said pressure pad which is in contact with the second surface of said object to be polished is a flat and smooth surface having substantially no irregularities.

7. A chemical and mechanical polishing apparatus comprising:

a surface plate adapted to be rotatable and having a polishing pad attached thereto through a soft elastic pad;

a carrier having a support surface for supporting an object to be polished which has a first surface and a second surface on the opposite sides thereof;

a pressure pad attached to said support surface of said carrier for urging said object to be polished against said polishing pad, said pressure pad being formed of a porous elastic member of a thickness corresponding to a predetermined amount of elastic deformation such that it is deformable along a contour of the second surface of said object to thereby maintain the second surface of said object to be polished at a substantially flat state when urging said object against said polishing pad; and a holding means provided on said carrier for holding said object to be polished on said pressure pad;

whereby the first surface of said object, which is urged from the second surface thereof into contact with said polishing pad of said surface plate by means of said carrier through said pressure pad, is polished by said rotating polishing pad.

8. The chemical and mechanical polishing apparatus according to claim 7, wherein said holding means comprises an air passage which opens on the support surface of said carrier for drawing air.

9. The chemical and mechanical polishing apparatus according to claim 7, wherein said porous elastic member has a multitude of minute pores.

10. The chemical and mechanical polishing apparatus according to claim 7, wherein said porous elastic member comprises a trifluorochloroethylene resin.

11. The chemical and mechanical polishing apparatus according to claim 10, wherein said porous elastic member comprising a trifluorochloroethylene resin has a thickness of about 8 mm or more.

12. The chemical and mechanical polishing apparatus according to claim 7, wherein that surface of said pressure pad which is in contact with the second surface of said object to be polished is a flat and smooth surface having substantially no irregularities.

* * * * *